US010058915B2

(12) United States Patent
Uehara et al.

(10) Patent No.: US 10,058,915 B2
(45) Date of Patent: Aug. 28, 2018

(54) CASTING DIE DEVICE AND CASTING METHOD

(71) Applicant: KEIHIN CORPORATION, Tokyo (JP)

(72) Inventors: Tetsuya Uehara, Iwanuma (JP); Fumihiro Sakuma, Shiroishi (JP)

(73) Assignee: KEIHIN CORPORATION, Tokyo (JP)

( * ) Notice: Subject to any disclaimer, the term of this patent is extended or adjusted under 35 U.S.C. 154(b) by 104 days.

(21) Appl. No.: 15/129,977

(22) PCT Filed: Mar. 24, 2015

(86) PCT No.: PCT/JP2015/058808

§ 371 (c)(1),
(2) Date: Sep. 28, 2016

(87) PCT Pub. No.: WO2015/151911

PCT Pub. Date: Oct. 8, 2015

(65) Prior Publication Data

US 2017/0136533 A1 May 18, 2017

(30) Foreign Application Priority Data

Mar. 31, 2014 (JP) ..... 2014-073981

(51) Int. Cl.
*B22D 17/20* (2006.01)
*B22D 17/22* (2006.01)
(Continued)

(52) U.S. Cl.
CPC ..... *B22D 17/2069* (2013.01); *B22D 17/22* (2013.01); *B22D 17/24* (2013.01); *B22D 25/02* (2013.01); *B22D 27/08* (2013.01)

(58) Field of Classification Search
CPC .... B22D 17/2069; B22D 17/22; B22D 17/24; B22D 27/08
(Continued)

(56) References Cited

U.S. PATENT DOCUMENTS 5,560,419 A * 10/1996 Yoshida ..... B22D 17/12 164/120
5,623,984 A * 4/1997 Nozaki ..... B22D 17/32 164/120
5,787,963 A * 8/1998 Tsuji ..... B22D 27/11 164/120

FOREIGN PATENT DOCUMENTS

JP 02-274361 11/1990
JP 03-000457 1/1991
(Continued)

OTHER PUBLICATIONS

Uchino, "Piezoelectric ultrasonic motors: overview", Smart Materials and Structure, 1998, pp. 273-285.*
(Continued)

*Primary Examiner* — Kevin E Yoon
(74) *Attorney, Agent, or Firm* — Rankin, Hill & Clark LLP

(57) ABSTRACT

A casting die device and a casting method. The casting die device has a core pin for forming an inner hole in a casted article. The core pin is a hollow body, and a pressurizing pin is inserted into a hollow inner part of the core pin. Vibrations from a vibrator of a micro vibration machine are imparted to the pressurizing pin via a vibration transmission member. The vibrations further propagate to the core pin from the pressurizing pin, and then propagate to the area surrounding the core pin in a molten metal that has been poured into a cavity.

4 Claims, 5 Drawing Sheets

(51) Int. Cl.

| | |
|---|---|
| ***B22D 27/08*** | (2006.01) |
| ***B22D 17/24*** | (2006.01) |
| ***B22D 25/02*** | (2006.01) |

(58) Field of Classification Search
USPC ..... 164/71.1, 113, 260, 303–318, 369, 501
See application file for complete search history.

(56) References Cited

FOREIGN PATENT DOCUMENTS

| | | |
|---|---|---|
| JP | 04-182053 | 6/1992 |
| JP | 07-001102 | 1/1995 |
| JP | 09-076306 | 3/1997 |

OTHER PUBLICATIONS

Chinese Office Action dated Jul. 5, 017, English translation included, 15 pages.
International Search Report, dated Jun. 16, 2015 (dated Jun. 16, 2015).

* cited by examiner

CASTING DIE DEVICE AND CASTING METHOD

TECHNICAL FIELD

The present invention relates to a casting die device and a casting method for obtaining a cast product in which an inner hole, at least one end of which is open, is formed.

BACKGROUND ART

High pressure casting (die casting) is known as a method of obtaining, e.g., cast products of aluminum alloy. In the high pressure casting, the obtained cast products have excellent dimensional accuracy, and the high pressure casting enables mass production advantageously. Therefore, the high pressure casting method has been adopted widely.

In high pressure casting, molten metal poured into a plunger sleeve is extruded by a plunger tip, and the molten metal is supplied to a cavity. That is, an injection process is performed in the casting method.

In the process, the molten metal passes through a narrow runner and a gate, and is supplied into a cavity. In this case, for example, the molten metal staying in the gate may be solidified earlier than the molten metal which has reached the cavity. In such a situation, molten metal for a rise is not poured sufficiently. Therefore, this is one of factors which may cause occurrence of casting defects such as blow holes or cracks in the cast product.

In an attempt to avoid the occurrence of such defects, in a technique proposed in Japanese Laid-Open Patent Publication No. 07-001102, a pressurizing pin for applying pressure to molten metal in a cavity is provided. Further, vibrations are applied to the pressurizing pin from a vibration device such as a mechanical vibration generator or an ultrasonic vibrator.

SUMMARY OF INVENTION

For example, in the case of obtaining a valve body of a spool valve as a cast product, it is required to form a valve hole (inner hole) for slidably inserting a spool as a valve member. The valve hole of this type is formed by a core pin, for example. That is, the core pin is inserted into the cavity beforehand. In this state, the molten metal is poured into the cavity. After the molten metal is solidified and the cast product is obtained, the core pin is removed or separated away from the cast product, whereby a hollow portion having a shape corresponding to the shape of the core pin is formed. The hollow portion serves as the valve hole.

An inner wall surface (casting surface) of the valve hole normally has casting defects such as blow holes or flow lines. Application of vibrations to the pressurizing pin as described in Japanese Laid-Open Patent Publication No. 07-001102 is effective in reducing casting defects on outer surfaces of the cast product. However, in this method, it is difficult to reduce casting defects in the inner hole formed by the core pin, such as the valve hole. This is because the pressurizing pin never contacts the surface of the inner hole.

A main object of the present invention is to provide a casting die device having a simple structure which makes it possible to obtain a cast product with reduced casting defects in an inner wall surface of an inner hole of the cast product.

Another object of the present invention is to provide a casting method which makes it possible to obtain the above cast product.

According to one embodiment of the present invention, a casting die device is provided, for obtaining a cast product, an inner hole being formed in the cast product, at least one end of the inner hole being open. The casting die device includes a core pin having a hollow structure and configured to form the inner hole, a pressurizing pin inserted into a hollow interior portion of the core pin, and configured to be displaced by operation of a displacement drive source and apply pressure to molten metal introduced into a cavity, a vibration generating unit configured to generate vibrations applied to the pressurizing pin, and a vibration transmission member configured to transmit the vibrations generated by the vibration generating unit to the pressurizing pin.

Further, according to another embodiment of the present invention, a casting method is provided for obtaining a cast product, an inner hole being formed in the cast product, at least one end of the inner hole being open. The method includes the steps of forming a cavity into which a core pin is inserted, the core pin having a hollow structure and being configured to form the inner hole, introducing molten metal into the cavity, and applying pressure to the molten metal introduced into the cavity, by a pressurizing pin inserted into a hollow interior portion of the core pin. Vibrations generated by a vibration generating unit are applied to the pressurizing pin through a vibration transmission member to thereby apply the vibrations to the molten metal in the cavity.

It should be noted that the term "inner hole" includes the meanings of a through hole both ends of which are open, and a bottomed hole one end of which is closed. Further, the term "sound surface" and the term "sound layer" as used below refer to a surface and a layer where casting defects, such as blow holes or flow lines, etc., of a size that results in leakage of internal substance inside the inner hole cannot be recognized.

That is, in the present invention, the core pin has a hollow structure, and the pressurizing pin is inserted into the hollow interior portion of the core pin. Therefore, even though the core pin and the pressurizing pin are used in combination, it is possible to simplify the structure.

Further, since vibrations are transmitted to the core pin, the inner wall surface of the inner hole where casting defects are not easily reduced only by the pressurizing pin, can be formed as a sound surface. That is, in the inner wall surface of the inner hole, casting defects, such as blow holes or flow lines having a size of a degree that causes leakage of internal substance (e.g., hydraulic oil, etc.) inside the inner hole cannot be recognized. Further, the inner wall surface has a good appearance.

Therefore, it is possible to directly use the inner wall surface as it is, i.e., the casting surface, as the inner wall, without the need to carry out a grinding treatment, a mirror finishing treatment, etc. Consequently, the number of steps required for processing the cast product into the finished product is reduced, and cost reduction is achieved. Further, in this case, since grinding dust is not generated, improvement in the material yield is achieved.

Moreover, in this case, the amount of burrs is also reduced. Additionally, since no grinding treatment or the like is required, grinding dust is not generated. For these reasons, improvement in the material yield is achieved.

Further, an internal portion of the cast product from the casting surface up to a predetermined depth forms substantially a sound layer. That is, no casting defects having a size of a degree that causes leakage of internal substance can be recognized in the internal portion of the cast product from the casting surface up to the predetermined depth. Therefore, for example, about half of the predetermined depth (i.e., half of the sound layer) may be removed by a grinding process, and a newly exposed surface (processed surface) may be used as the inner wall of the inner hole.

Preferably, the displacement drive source for displacing the pressurizing pin has a hollow structure. In this case, by inserting a vibration transmission member into a hollow interior portion of the displacement drive source, it becomes easy to apply vibrations to the pressurizing pin through the vibration transmission member.

As a suitable example of this type of displacement drive source, there may be presented a double rod type cylinder including two displacement rods each having a hollow structure.

As the vibration device, for example, a micro-vibration generator (air vibrator, etc.) for generating mechanical vibrations at the vibration frequency of one hundred to several hundred Hz may be adopted. Alternatively, the vibration device may be an ultrasonic vibration generator for generating ultrasonic vibrations.

Further, at the time of pouring the molten metal into the cavity, preferably, pressure is applied to the molten metal. That is, preferably, the casting die device is a high pressure casting die device, and the casting method is a high pressure die casting (HPDC) method.

DESCRIPTION OF EMBODIMENTS

Hereinafter, a preferred embodiment of a casting method according to the present invention will be described in detail in connection with a casting die device for carrying out the casting method, with reference to the accompanying drawings. In the embodiment of the present invention, a valve body of a spool valve is shown as an example of a cast product.

Figure 1:
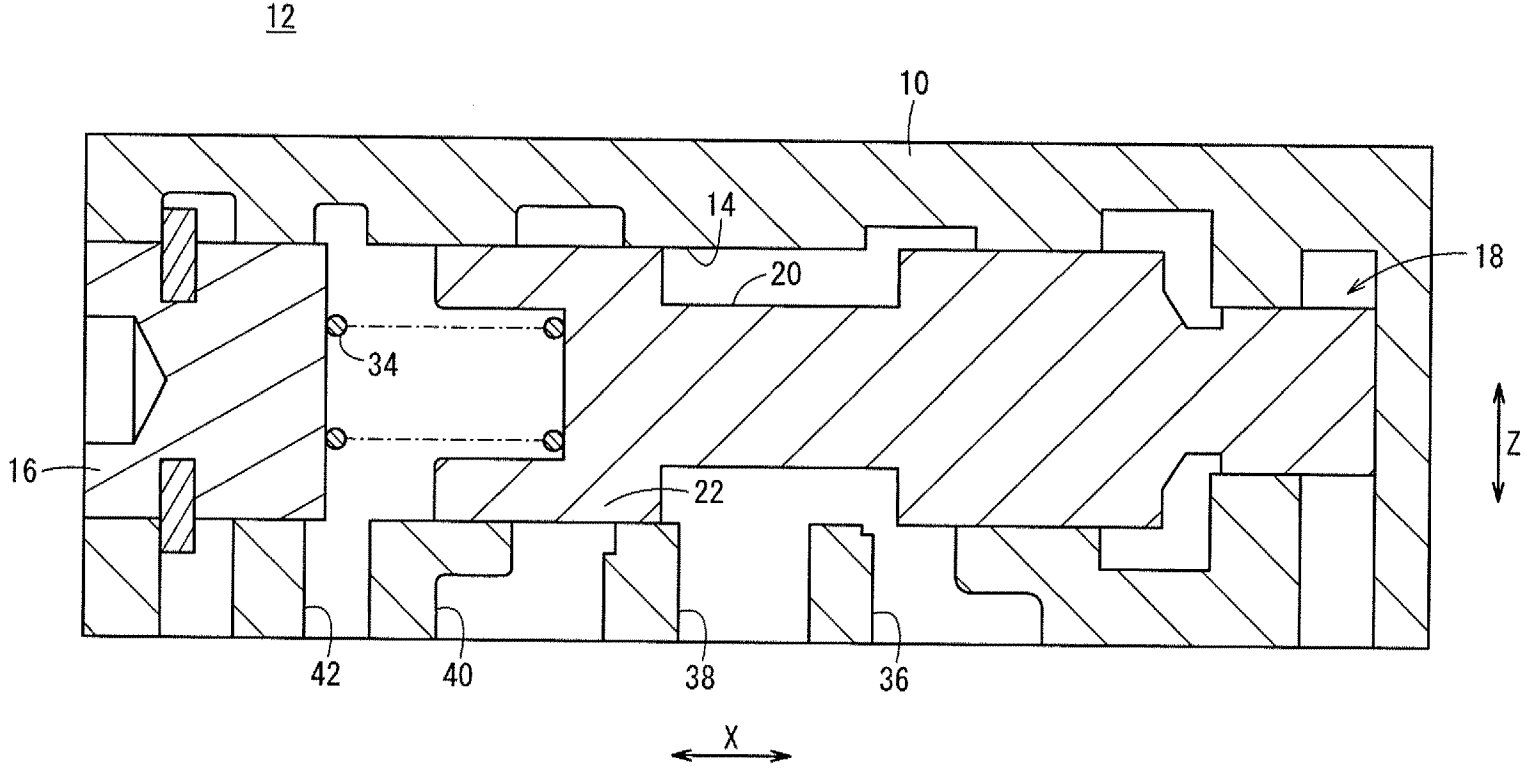
FIG. 1 is a vertical cross-sectional view taken along a thickness direction of a spool valve having a valve body (cast product), obtained by a casting method according to an embodiment of the present invention.

Firstly, the spool valve will be described with reference to FIG. 1. FIG. 1 is a vertical cross-sectional view taken along a thickness direction (the direction indicated by arrow Z in FIG. 1) of a spool valve 12. The spool valve 12 has a valve body 10 as a cast product. In the valve body 10, a valve hole 14 is formed as an inner hole extending in an axial direction, e.g., in a longitudinal direction (the direction indicated by arrow X in FIG. 1).

The valve hole 14 opens on one end in the direction of the arrow X. The opened end is closed by a cap member 16. The other end is closed by an inner wall of the valve body 10. The inner wall functions as a stopper wall for blocking a spool 18 (valve member).

The valve body 10 has an inlet port 36 through which a hydraulic oil is introduced into the valve hole 14, an outlet port 38 through which the hydraulic oil is led out from the valve hole 14, a drain port 40, and a hydraulic oil supply port 42 through which the hydraulic oil is supplied from another valve (not shown). FIG. 1 shows a state where the spool 18 is biased elastically by a pressure regulating spring 34, and one end surface of the spool 18 abuts against (contacts or is blocked by) the stopper wall. In this state, the inlet port 36 and the outlet port 38 are placed in communication with each other through an annular groove 20 of the spool 18. On the other hand, the drain port 40 is closed or sealed by a large diameter portion 22.

Figure 2:
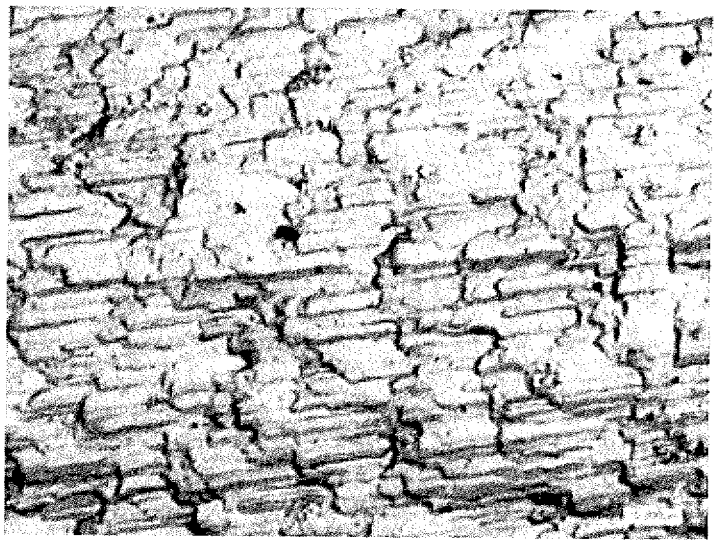
FIG. 2 is a high magnification laser microscopic photograph of an inner wall of a valve hole (inner hole) formed in the valve body.

The inner wall of the valve hole 14 defines a casting surface that exhibits a metallic luster. Further, as can be seen from FIG. 2 which is a high magnification laser microscopic photograph of the inner wall (casting surface), blow holes or flow lines, etc., having a size of a degree that causes leakage of the hydraulic oil, are not recognized on the inner wall (casting surface). That is, even though the inner wall is a casting surface that is not subjected to a grinding treatment or a mirror finishing treatment or the like, the inner wall forms a sound surface in which casting defects cannot be recognized, and moreover, the surface has a good aesthetic appearance.

Figure 3:
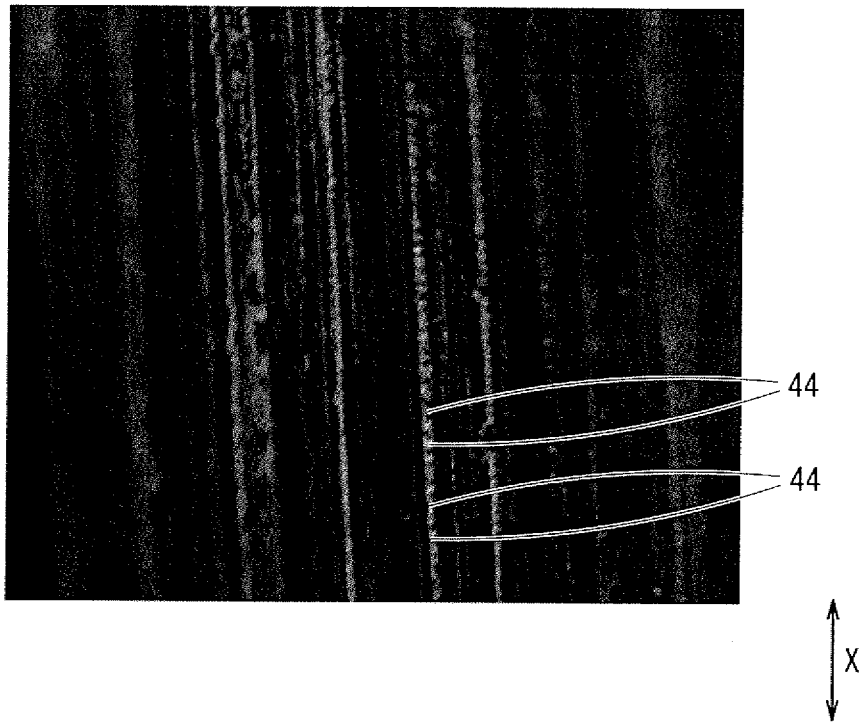
FIG. 3 is a low magnification laser microscopic photograph of an inner wall of a valve hole (inner hole) formed in the valve body.

Further, as shown in FIG. 3, on the casting surface that forms the inner wall, a plurality of fine lines 44, which are visible when observed at low magnification by a laser microscope, extend in a direction perpendicular to a longitudinal direction (indicated by an arrow X). Such lines 44 cannot be observed on the inner wall of a valve hole formed without applying vibrations. That is, the lines 44 are believed to be formed as a result of application of vibrations. It should be noted that the lines 44 do not cause leakage.

As will be described later, the valve hole 14 is formed by a core pin 92 (see FIG. 4) to which vibrations are applied. It is presumed that the distance between the adjacent lines 44 correspond to the frequency of vibrations.

Further, casting defects having a size of a degree that causes leakage of hydraulic oil, cannot be recognized in an inner portion from the inner wall surface of the valve hole 14 that forms the casting surface, up to a depth of at least 1 mm. That is, in the valve body 10, the inner portion thereof from the inner wall surface of the valve hole 14 to the depth of 1 mm is a so-called a sound layer.

Therefore, the casting surface can be used directly as it is, as the inner wall of the valve hole 14. Stated otherwise, there is no particular need to carry out a complex operation such as grinding or the like with respect to the casting surface of the valve hole 14. Further, as a result, the number of steps required for obtaining a practically usable valve body 10 is reduced, and a commensurate reduction in the cost is achieved. However, grinding treatment may be applied to the inner wall of the valve hole 14, as will be described later.

The valve body 10, in which the valve hole 14 (inner hole) having such an inner wall (casting surface) is formed, can be produced by the casting operation to be described below.

Firstly, the casting die device 50 will be described. The casting die device 50 is, for example, a high pressure casting die device for applying a pressure of 35 to 100 MPa to molten metal 66. The casting die device 50 includes a fixed die 52 whose position is fixed, and a movable die 54 which is displaceable in directions to approach toward or separate away from the fixed die 52. A first insert 56 is disposed in the fixed die 52, and a second insert 58 is disposed in the movable die 54. By closing the dies 52, 54, a cavity 60 is formed by the first insert 56 and the second insert 58.

A fitting hole 62 is formed to penetrate through the fixed die 52, and a plunger sleeve 64 is fitted into the fitting hole 62. A molten metal supply port (not shown) is formed at an upper position of the plunger sleeve 64. Molten metal (e.g., molten aluminum alloy) 66 is supplied from the molten metal supply port into the plunger sleeve 64.

A plunger tip 70 is slidably arranged in the plunger sleeve 64. The plunger tip 70 is coupled to an injection rod 68 of an injection cylinder (not shown). Therefore, the molten metal 66 supplied into the plunger sleeve 64 is pushed out by the plunger tip 70. Further, a runner 72 is formed from a front end of the plunger sleeve 64 up to the cavity 60. The runner 72 is a passage for guiding the molten metal 66 outflowing from the plunger sleeve 64 into the cavity 60.

Further, in the casting die device 50, a core 74 is disposed. The core 74 includes a pin retaining member 76 and a strut supporting member 78 connected to the pin retaining member 76. The core 74 is displaceable in the vertical direction in FIG. 4 under operation of a sliding mechanism (not shown) provided on the strut supporting member 78.

A stepped hole 80 extending toward the cavity 60 is formed so as to penetrate through the pin retaining member 76. The diameter of the stepped hole 80 is expanded on the strut supporting member 78 side to thereby form a support step 82. A guide hole 84 is formed so as to penetrate through the strut supporting member 78. The guide hole 84 is connected to the stepped hole 80. The diameter of the guide hole 84 is expanded on the strut supporting member 78 side, to thereby form a blocking step 86 in the guide hole 84.

A core pin 92 is inserted into the stepped hole 80. The core pin 92 includes a shaft 88 and a head 90 having a slightly large diameter. The head 90 of the core pin 92 is supported by the support step 82 of the stepped hole 80 to thereby retain the core pin 92 by the pin retaining member 76. Therefore, the core pin 92 is displaced integrally with the core 74, and the front end of the shaft 88 of the core pin 92 enters into the cavity 60 at the time of die closing. The front end of the shaft 88 forms the valve hole 14 (see FIG. 1).

It should be noted that clearance in a range of about 0.01 to 0.1 mm is formed between the core pin 92 and the inner wall of the stepped hole 80. Therefore, the core pin 92 can sway or rotate inside the stepped hole 80.

The outer circumference of the shaft 88 of the core pin 92 has a straight shape without any draft angle. Accordingly, the valve hole 14 has a straight shape as well. In this case, in comparison with a tapered valve hole having a draft angle, machining of the valve hole 14 can be performed easily, and it becomes possible to reduce the amount of machining.

In this regard, the core pin 92 has a hollow structure where a slide hole 94 penetrates and extends through the core pin 92 in the longitudinal direction. A lower end of an elongated pressing shaft 98 of a pressurizing pin 96 is inserted into the slide hole 94. Clearance in a range of about 0.01 to 0.1 mm is formed between the slide hole 94 and the lower end of the pressing shaft 98.

A large diameter flange 100 is formed at a substantially intermediate position of the pressing shaft 98 of the pressurizing pin 96 in the longitudinal direction thereof so as to protrude outward in the diameter direction. The flange 100 abuts against the blocking step 86, whereby further downward movement of the pressurizing pin 96 is blocked. It should be noted that clearance in a range of about 0.01 to 0.1 mm is also formed between the guide hole 84 and the lower end of the pressing shaft 98, and between the guide hole 84 and the flange 100.

The pressurizing pin 96 is displaced (raised or lowered) by a double rod type cylinder 102 as a displacement drive source. The double rod type cylinder 102 has a cylinder main body 106 supported by a strut 104 provided upright in the strut supporting member 78. The cylinder main body 106 is equipped with a lower rod 108 and an upper rod 110 (displacement rods). The lower rod 108 and the upper rod 110 move back and forth cooperatively such that the lower rod 108 and the upper rod 110 are protruded from or retracted in the cylinder main body 106. All of the cylinder main body 106, the lower rod 108, and the upper rod 110 have a hollow structure.

A rod-shaped vibration transmission member 112 of a vibration device is inserted into a hollow interior portion of the double rod type cylinder 102 (i.e., an inner hole extending from the lower rod 108 to the upper rod 110). A threaded portion 114 having a small diameter protrudes from a lower end of the vibration transmission member 112, and the threaded portion 114 is screwed into a screw hole 116 formed in an upper end of the pressurizing pin 96. In this manner, the vibration transmission member 112 is coupled to the pressurizing pin 96.

A micro-vibration generator 118 (vibration generating unit) of the vibration device is supported at an upper end of the upper rod 110. The vibration transmission member 112 and the micro-vibration generator 118 jointly form the vibration device. Therefore, the micro-vibration generator 118 is displaced such that the micro-vibration generator follows the forward movement/backward movement, i.e., upward/downward movement, of the upper rod 110. As the micro-vibration generator 118, for example, an air vibrator may be used.

The upper end of the vibration transmission member 112 faces a vibration element 120 of the micro-vibration generator 118. When the micro-vibration generator 118 is not actuated, the lower end surface of the vibration element 120 is separated from the upper end surface of the vibration transmission member 112 by a predetermined distance.

When the micro-vibration generator 118 is actuated, the vibration element 120 moves up and down at a predetermined cycle. The stroke of the vibration element 120 is slightly larger than the distance between the vibration element 120 and the vibration transmission member 112. Therefore, when the vibration element 120 is lowered, the vibration element 120 abuts against the vibration transmission member 112. It is a matter of course that when the vibration element 120 is raised, the vibration element 120 is separated from the vibration transmission member 112. In this manner, by repeatedly carrying out abutment and separation of the vibration element 120, vibrations at a predetermined frequency are applied to the vibration transmission member 112.

In this regard, since the vibration element 120 is separated from the vibration transmission member 112 by a predetermined distance, when the vibration element 120 abuts against the vibration transmission member 112, collision energy is generated. It is presumed that vibrations of a predetermined frequency to which such collision energy is added are applied to the vibration transmission member 112.

The casting operation for obtaining the valve body 10, i.e., the casing method according to the embodiment of the present invention, is carried out in the following manner, using the casting die device 50 having the above structure.

Figure 4:
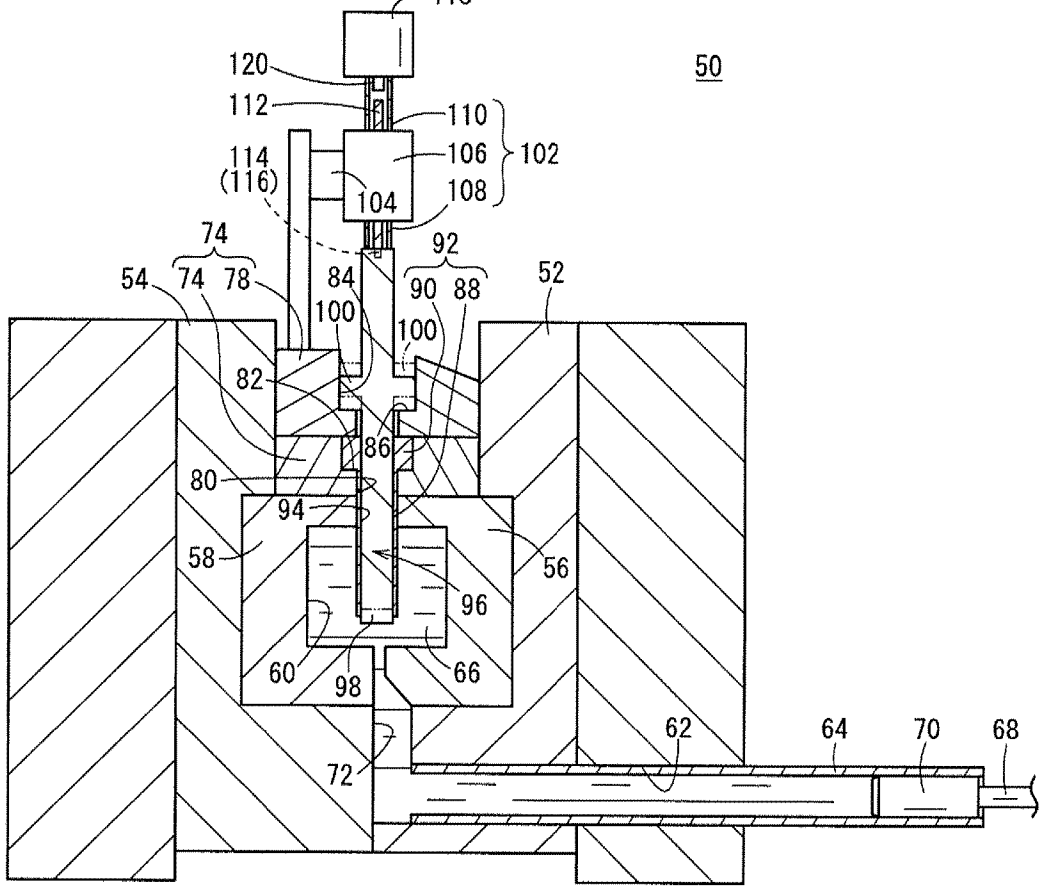
FIG. 4 is a vertical cross-sectional view of main parts of a casting die device according to an embodiment of the present invention.

Firstly, the movable die 54 is displaced toward the fixed die 52. Then, the core 74 is lowered, and the dies 52, 54 are closed. As a result, the core pin 92 enters into the cavity 60 formed by the first insert 56 and the second insert 58. At this time point, the lower rod 108 and the upper rod 110 of the double rod type cylinder 102 are positioned at raised positions. Therefore, the pressurizing pin 96 is positioned at a raised position as well. In FIG. 4, the position of the front end of the pressurizing pin 96 and the position of the flange 100 at this time point are shown by imaginary lines.

Next, the micro-vibration generator 118 is actuated to move the vibration element 120 up and down. As described above, when the vibration element 120 is lowered, the vibration element 120 comes into abutment against the vibration transmission member 112, and when the vibration element 120 is raised, the vibration element 120 is separated from the vibration transmission member 112. Therefore, vibrations at a predetermined frequency are applied to the vibration transmission member 112. For example, the vibrations are mechanical vibrations, the frequency of which is in a range of one hundred to several hundred Hz.

As described above, the lower end of the vibration transmission member 112 is coupled to the upper end of the pressurizing pin 96. As a result, vibrations are transmitted to the pressurizing pin 96. Therefore, the pressurizing pin 96 is vibrated in the slide hole 94, and repeatedly carries out collision and separation with respect to the inner wall of the slide hole 94, and consequently, the core pin 92 is vibrated. In this manner, vibrations are transmitted to the core pin 92. Since clearance is present between the core pin 92 and the inner wall of the stepped hole 80, when the core pin 92 is vibrated, the core pin 92 can sway in the diameter direction, or rotate in the circumferential direction.

In this state, next, the molten metal 66 (e.g., molten metal of aluminum alloy) is supplied from a molten metal supply port formed on the plunger sleeve 64. After a predetermined quantity of the molten metal 66 is introduced into the plunger sleeve 64, an injection cylinder (not shown) is actuated, and accordingly an injection rod 68 moves forward. Following this movement, the plunger tip 70 slides in a direction to push the molten metal 66.

As a result, the molten metal 66 supplied into the plunger sleeve 64 is extruded from the plunger sleeve 64 by the plunger tip 70, and guided by the runner 72, so that the molten metal 66 reaches the cavity 60. That is, the molten metal 66 is supplied to the cavity 60, and the cavity 60 is filled with the molten metal 66. Thus, in the embodiment of the present invention, pressure is applied to the molten metal 66 in the plunger sleeve 64, whereby the molten metal 66 is introduced into the cavity 60 to perform high pressure die casting (HPDC).

In this regard, the core pin 92 is inserted into the cavity 60. In the embodiment of the present invention, as described above, vibrations are applied to the core pin 92. Therefore, the vibrations are reliably applied to a portion that surrounds the core pin 92, of the molten metal 66 supplied into the cavity 60 (hereinafter referred to as a "core pin surrounding region") through the core pin 92. That is, the core pin surrounding region, which eventually becomes the inner wall of the valve hole 14, can be vibrated directly.

In this case, the pressurizing pin 96 repeatedly moves forward (protrudes from the core pin 92) and backward (enters the core pin 92), through the opening at the front end of the slide hole 94 formed in the core pin 92. At this time, the pressurizing pin 96 abuts against and is separated away from the core pin surrounding region. Also by this movement, vibrations are transmitted to the core pin surrounding region.

When the vibration element 120 is separated from the core pin 92, the core pin 92 is pushed by the viscoelasticity of the core pin surrounding region (molten metal 66), and returns to substantially the original position.

Application of the vibrations continues until the dies are opened. Therefore, vibrations continue to be applied to the core pin surrounding region, i.e., a portion forming the inner wall of the valve hole 14, from when the molten metal contacts the core pin 92 until when the molten metal is placed in a solid state (solidified). Since the core pin 92 sways in the diameter direction easily, and rotates in the circumferential direction easily, the vibrations can be transmitted, in particular, to the diameter direction and/or the circumferential direction of the core pin 92 easily.

Further, since a tiny gap (clearance) is formed between the inner wall of the slide hole 94 of the core pin 92 and the circumferential side wall of the pressurizing pin 96, when the vibrations are applied, frictional heat is produced between the core pin 92 and the pressurizing pin 96 by sliding/vibrating movement. In the structure, since heat is produced in the core pin 92, the core pin surrounding region of the molten metal 66 is heated. In the structure, improvement in the running performance of the molten metal 66 in the core pin surrounding region is achieved advantageously.

Further, when vibrations are applied to the core pin surrounding region in the molten metal 66, the sizes of bubbles in the molten metal 66 are reduced by cavitation phenomenon, and the bubbles move in a direction away from the vibration source (core pin 92). It should be noted that the reduced bubble sizes are about $\phi$0.1 mm.

As described above, in the embodiment of the present invention, the core pin 92 has a hollow structure, and the pressurizing pin 96 is inserted into the hollow interior portion of the core pin 92. Therefore, while the structure is simplified, it is possible to use the core pin 92 and the pressurizing pin 96 in combination in a single casting die device.

After the cavity 60 is filled with the molten metal 66, the double rod type cylinder 102 is actuated. Accordingly, when the lower rod 108 and the upper rod 110 are lowered, the pressurizing pin 96 is pushed by the lower rod 108, and the lower end of the pressurizing pin 96 is lowered from a position indicated by an imaginary line to a position indicated by a solid line in FIG. 4, and protrudes slightly beyond the lower end of the core pin 92. The pressurizing pin 96 is lowered in this manner, whereby pressure is applied to the molten metal 66 in the cavity 60. It should be noted that, following the downward movement of the lower rod 108 and the upper rod 110, the micro-vibration generator 118 supported by the upper rod 110 is lowered as well.

Figure 5B:
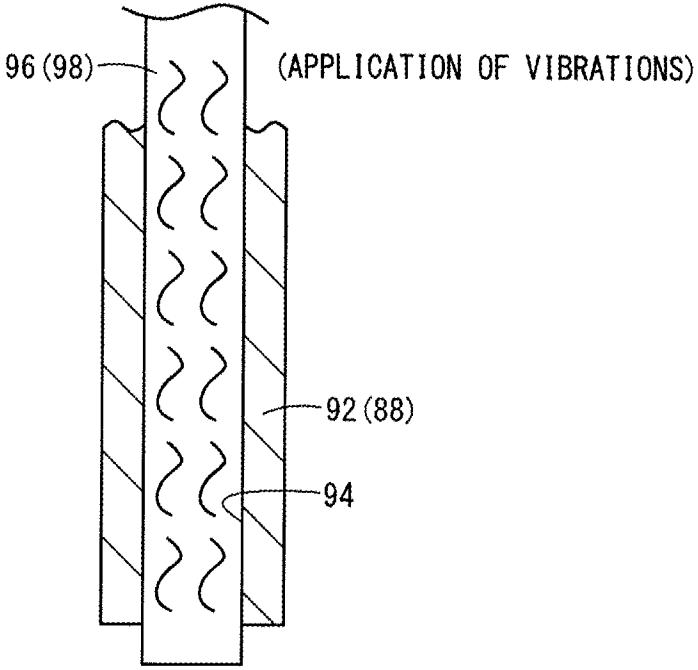
FIG. 5A and FIG. 5B are views showing a process flow in the case of displacing a vibrated pressurizing pin in a hollow interior portion (slide hole) of a core pin, in the casting die device.
Figure 5A:
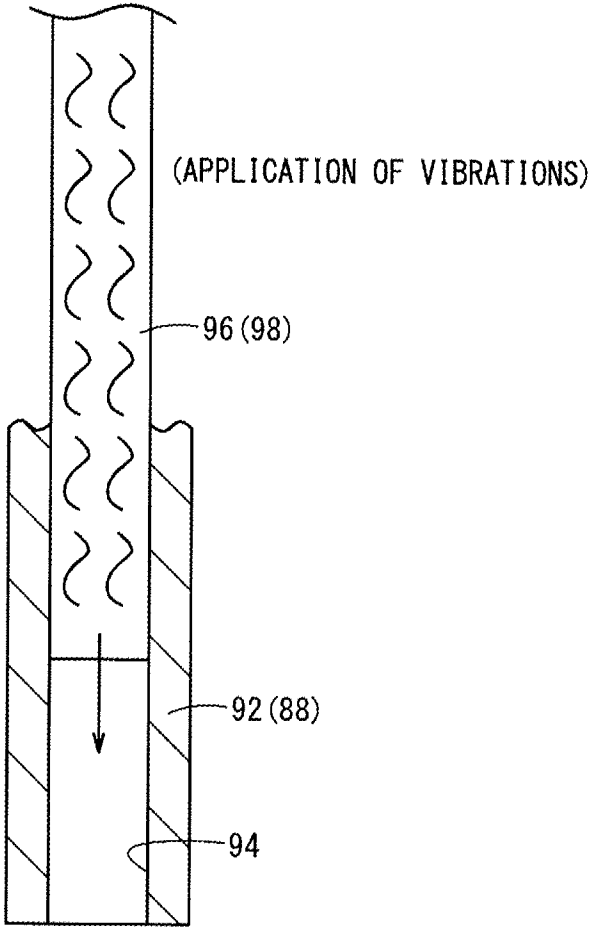

During the downward movement, the lower end of the pressing shaft 98 of the pressurizing pin 96 slides inside the slide hole 94, as illustrated in a process flow of FIGS. 5A and 5B. At this time, vibrations from the micro-vibration generator 118 are applied beforehand to the pressurizing pin 96 through the vibration transmission member 112. In this case, the sliding resistance against the pressing shaft 98 is small in comparison with the case where non-vibrated vibration transmission member 112 slides in the slide hole 94. Therefore, it becomes possible to avoid galling in the inner wall of the slide hole 94 and in the outer surface of the pressurizing pin 96.

The movement of the pressurizing pin 96 is blocked by the flange 100 of the pressurizing pin 96 abutting against the blocking step 86 in the guide hole 84 formed in the strut supporting member 78. That is, further downward movement of the pressurizing pin 96 is blocked or prevented.

Thereafter, the molten metal 66 in the cavity 60 becomes solidified. Thus, the valve body 10 having a shape corresponding to the shape of the cavity 60 is obtained. The valve hole 14 is formed at a position corresponding to the core pin 92.

After elapse of a predetermined time from the end of supplying the molten metal 66 to the cavity 60, the core 74 is raised, and the movable die 54 is separated away from the fixed die 52, whereby the dies 52, 54 are opened. As a result, the valve body 10 is exposed.

As described above, vibrations are applied to the pressurizing pin 96 and the core pin 92, whereby the core pin surrounding region is vibrated sufficiently. Further, the sizes of the bubbles in the core pin surrounding region are reduced sufficiently. Therefore, in the valve body 10, the inner wall of the valve hole 14 shows metallic luster, and is formed as a casting surface (sound surface) where no blow holes or flow lines (casting defects) having a size of a degree that causes leakage of hydraulic oil can be recognized. Further, the maximum surface roughness of the casting surface is about 1.5 μm. Further, the internal portion of the inner wall in the depth direction in a range of 1 mm is also formed as a sound layer where no blow holes or flow lines (casting defects) having a size that causes leakage of hydraulic oil can be recognized.

Further, in the casting surface, a plurality of lines 44 (see FIG. 3) are formed in a direction perpendicular to the axial direction (direction in which the core pin 92 is pulled out). It is presumed that the distance between the adjacent lines 44 corresponds to the vibration frequency of the vibration element 120.

In a general casting technique where applying of vibrations is not carried out, casting defects tend to be present in the inner wall (casting surface) of the valve hole 14 immediately after the core pin 92 has been pulled out. Therefore, if the casting surface is directly used as the inner wall without any processes, there is a concern that leakage of the hydraulic oil may occur.

In contrast, in the embodiment of the present invention, as described above, the casting surface is formed as a sound surface where no casting defects are recognized. Therefore, the inner wall can function as the valve hole 14 in which the valve member is accommodated, without the need to carry out an operation such as grinding or the like with respect to the inner wall (casting surface) of the valve hole 14. That is, there is no particular need to perform a grinding process. Accordingly, the number of process steps required for obtaining the valve body 10, and thus the spool valve 12, is reduced. For this reason, it is possible to achieve cost reduction.

Further, in the case where casting is carried out while vibrations are applied to the core pin surrounding region, there is an advantage in that burrs that are formed in the valve body 10 are made smaller in size. Additionally, since no grinding process is required, and no grinding dust is produced, portions of material that become scrap material are reduced. Therefore, improvement in the material yield is achieved.

Further, since vibrations are applied to the core pin surrounding region, the surface roughness of the inner wall (casting surface) of the valve hole 14 becomes small. More specifically, the maximum surface roughness was measured at a plurality of arbitrary positions on the inner wall of the valve hole 14, and it was found that the maximum surface roughness was not more than 1.5 μm.

Though it is difficult to avoid casting defects in the inner wall surface of the inner hole such as the valve hole only by the pressurizing pin 96, as described above, by inserting the pressurizing pin 96 into the core pin 92, the inner wall surface of the inner hole can be obtained as a sound surface. Further, the molten metal 66 is pressed by the pressurizing pin 96, and this point also contributes to reduction in the casting defects.

Moreover, while the outer circumference of the shaft 88 of the core pin 92 has a straight shape, it is possible to pull out the core pin 92 from the valve hole 14 without causing scoring or galling in the valve hole 14. Additionally, improvement in the circularity or roundness of the valve hole 14 is achieved.

The present invention is not limited to the above described embodiment, and various changes can be made without departing from the scope of the present invention.

For example, in the above-described embodiment, though mechanical vibrations are applied at the vibration frequency of one hundred to several hundred Hz, it is a matter of course that ultrasonic vibrations may be applied. In this case, instead of the micro-vibration generator 118, an ultrasonic vibrator may be adopted. Vibrations may be applied in a state where the front end of the vibration element 120 of the ultrasonic vibrator is not separated away from the upper end surface of the vibration transmission member 112, and are in abutting contact with the upper end surface of the vibration transmission member 112.

Further, the cast product, which is obtained in the above manner, is not limited to the valve body 10 of the spool valve 12, as long as the cast product has an inner hole formed by the vibrated core pin 92 or the like. As another example of such a cast product, a body of an actuator may be presented. In this case, for example, the inner hole is a slide hole for a piston.

Further, as yet another example, there may be presented a throttle body or a carburetor body. In this case, the inner hole is an air intake path, and the internal substance is air or an air-fuel mixture.

The invention claimed is:

1. A casting die device for obtaining a cast product, an inner hole being formed in the cast product, at least one end of the inner hole being open, the casting die device, comprising:

a core pin having a hollow structure and configured to form the inner hole; a displacement drive source;

a pressurizing pin inserted into a hollow interior portion of the core pin, and configured to be displaced by operation of the displacement drive source and apply pressure to molten metal introduced into a cavity;

a vibration generating unit configured to generate vibrations applied to the pressurizing pin; and a vibration transmission member configured to transmit the vibrations generated by the vibration generating unit to the pressurizing pin, wherein the vibration generating unit includes a vibration element; and in a state where the vibration element is stopped, the vibration element is separated from the vibration transmission member, and in a state where the vibration element is actuated, the vibration element repeatedly carries out abutment against and separation from the vibration transmission member, thereby generating mechanical vibrations.

2. The casting die device according to claim 1, wherein the displacement drive source has a hollow structure, and the vibration transmission member is inserted into a hollow interior portion of the displacement drive source.

3. The casting die device according to claim 2, wherein the displacement drive source is a double rod type cylinder including two displacement rods each having a hollow structure.

4. The casting die device according to claim 1, wherein the casting die device is a high pressure casting die device configured to carry out high pressure casting by applying pressure to the molten metal and introducing the molten metal into the cavity.

* * * * *